US005313983A

United States Patent [19]

Rost et al.

[11] Patent Number: 5,313,983

[45] Date of Patent: May 24, 1994

[54] REMOTE HYDRAULIC CONTROL SYSTEMS

[75] Inventors: Alvin S. Rost, Fridley; John M. Schurman, Brooklyn Park, both of Minn.

[73] Assignee: Dana Corporation, Toledo, Ohio

[21] Appl. No.: 37,824

[22] Filed: Mar. 29, 1993

[51] Int. Cl.[5] ..... F15B 13/042

[52] U.S. Cl. ..... 137/625.6; 251/29

[58] Field of Search ..... 137/625.6; 251/29

[56] References Cited

U.S. PATENT DOCUMENTS

| | | | |
|---|---|---|---|
| 3,304,953 | 2/1967 | Wickline et al. | 137/625.6 X |
| 3,340,897 | 9/1967 | Nevulis | 137/625.6 |
| 3,557,829 | 1/1971 | Finley . | |
| 3,805,674 | 4/1974 | Sebesta et al. . | |
| 4,024,798 | 5/1977 | Schexnayder et al. . | |
| 4,044,795 | 8/1977 | Tardy et al. | 137/625.6 |
| 4,354,527 | 10/1982 | McMillan . | |
| 4,355,660 | 10/1982 | Huffman . | |
| 4,730,543 | 3/1988 | Holmes . | |
| 5,081,905 | 1/1992 | Yagyu et al. | 137/625.6 X |

FOREIGN PATENT DOCUMENTS 3041788 6/1981 Fed. Rep. of Germany .

*Primary Examiner*—Gerald A. Michalsky

*Attorney, Agent, or Firm*—Millen, White, Zelano & Branigan

[57] ABSTRACT

Response times for a remote hydraulic control system having control lines from a remote controller to a main control valve of 50 feet or more are reduced by providing actuator pistons which are operated at a second pilot hydraulic pressure less than a first pilot hydraulic pressure used for moving a valve spool within the main control valve. The actuator pistons open valves which allow hydraulic fluid at the higher pilot pressure to push the valve spool. "Off" times are further reduced by continuously bleeding off a portion of the hydraulic fluid applied to the actuator pistons at the second hydraulic pressure.

16 Claims, 3 Drawing Sheets

REMOTE HYDRAULIC CONTROL SYSTEMS

FIELD OF THE INVENTION

The instant invention relates to improvements in remote hydraulic control systems. More particularly, the instant invention relates to improvements in remote hydraulic control systems which enhance response times thereof.

BACKGROUND ART

Remote hydraulic control systems have numerous applications for controlling hydraulic jacks and hydraulic motors which may, for example, be used to operate a wide variety of devices from earth moving equipment such as power shovels, loaders, bulldozers, and the like, to devices such as lifts and "cherry pickers". In use, it is frequently desirable to provide rapid response times. In some applications, long control lines from hydraulic remote controllers are utilized These control lines can exceed 50 ft. With long control lines, control response times become slow. In cold weather, control response times decrease further for outside applications.

The prior art does not recognize the phenomenon of slow response times for relatively long control lines, nor does the prior art suggest a solution to the problem inherent in utilizing long control lines.

In devices of interest with respect to the present invention, hydraulic jacks and motors are controlled by main control valves having valve spools which slide from a neutral position, determined by a positioning spring, to either a first or second operating position. When the valve spool is in the first position, the jack or motor advances or rotates in a first direction and when the valve spool is in the second position, the jack or motor advances or rotates in a second direction. The position of the valve spool is determined by a remote controller which may be operated manually to select which way the valve spool moves.

In prior art devices, pilot hydraulic fluid at relatively high pilot pressure is applied directly to opposite ends of the valve spool. This requires that a relatively large volume of pilot hydraulic fluid be transmitted. When a system requires a manual or other controller which is remotely displaced from a main control valve, the volume of pilot hydraulic fluid which must be displaced through control lines is necessarily increased because control lines are lengthened. When these lengths approach 50 feet or more, response times tend to increase due to the increased volume of pilot hydraulic fluid which must be transported. Since it is usually desirable to minimize response times in any situation, there is a need for an approach to provide minimized response times when control lines approach 50 feet or more in length.

SUMMARY OF THE INVENTION

In view of the aforementioned considerations, it is a feature of the instant invention, among other features, to provide a new and improved remote hydraulic control system in which response times are minimized.

In view of this feature and other features, an improvement in remote control systems for operating hydraulically driven devices utilizes a main control valve having a valve spool therein wherein the main control valve includes chambers on opposite ends of the valve spool. Each of the chambers is connected to a source of pilot hydraulic fluid pressurized to a first pressure level for moving the valve spool upon application of pilot hydraulic fluid at the first pressure level to control the hydraulically driven device. A remote controller selects which chamber will be pressurized by the hydraulic fluid. The improvement is embodied in a hydraulic actuator in communication with each of the chambers wherein the hydraulic actuator controls flow of pilot hydraulic fluid to the chambers at the first pressure level by actuating the hydraulic actuators at a second pressure level less than the first pressure level.

In accordance with one feature of the present invention, the pressure to the valve spool is the same as the control pressure from the remote source because the same size pistons are used in a pressure reducing valve in the remote controller as in the actuator pistons within the actuator. By utilizing bleed-off orifices in the actuator pistons, pressure from the remote source decreases rapidly when the remote source is disconnected from the actuator.

The invention further contemplates a main control valve having a valve spool shiftable between at least two positions upon application of hydraulic pressure from a source of pilot hydraulic fluid at a first selected pressure. The pilot hydraulic fluid is applied at the first selected pressure upon moving an actuator piston from an inoperative to an operative position by applying pilot hydraulic fluid at a second selected pressure, lower than the first selected pressure, through hydraulic control lines of a length greater than a selected length. A portion of the hydraulic fluid applied to the piston at the second selected pressure bleeds past the piston and into a return line while the piston is in the operative position.

BRIEF DESCRIPTION OF THE DRAWINGS

Various other features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION

The Main Control Valve 28 (FIG. 1)—General Operation

Figure 1:
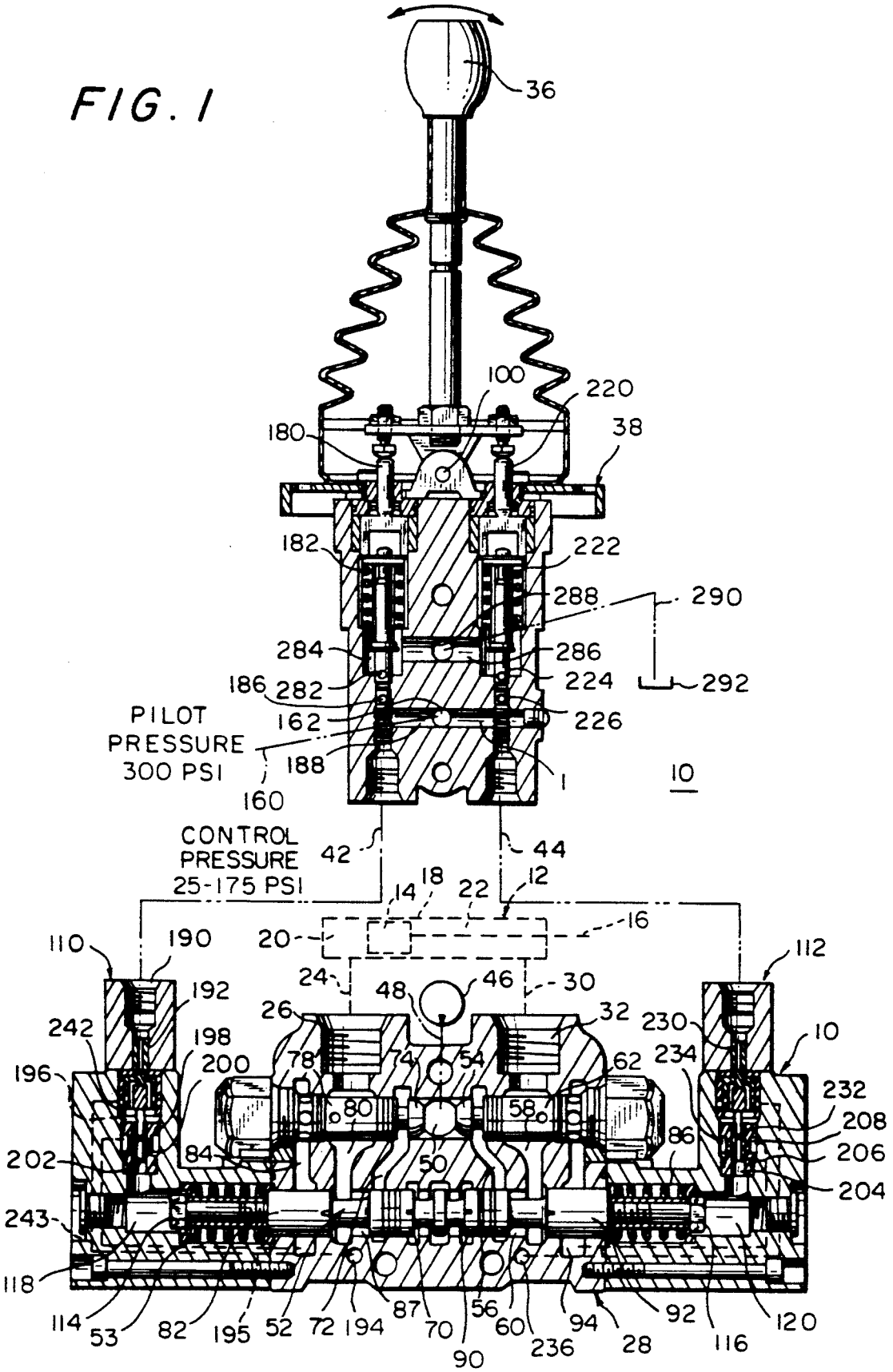
FIG. 1 is a composite view with component structures comprising the instant invention in elevation and connected to a diagrammatical illustration of a hydraulic device controlled by the hydraulic controller.

Referring now to FIG. 1, there is shown a remote hydraulic control system 10 for operating a hydraulic device 12 which may, for example, be in the form of a hydraulic cylinder or, alternatively, a hydraulic motor. If, for example, the hydraulic device 12 is a hydraulic cylinder, it will contain a working piston 14 and a piston rod 16 reciprocating in a cylinder 18 according to whether hydraulic fluid is accumulated in a first working chamber 20 on one side of the piston or in a second working chamber 22 on the other side of the piston. The first chamber 20 is connected by a line 24 to a first outlet or work port 26 of a main control valve 28 while the second chamber 22 is connected by a line 30 to a second outlet or work port 32 of the main control valve 28. It is emphasized that the schematically illustrated hydraulic cylinder 12 could alternatively be a hydraulic motor which runs in a first direction when connected to the work port 26 and in a second direction, opposite the first direction, when connected to the work port 32.

Whether it is the first outlet or work port 26 or the second outlet or work port 32 which is dispensing hydraulic fluid to the hydraulic cylinder 12 is determined by the position of a manual operator such as a joystick 36 of a remote controller 38. Alternatively, a foot pedal (not shown) or some other actuator may be used to operate the remote controller 38. As will be more fully explained hereinafter, the remote controller 38 is connected by a pair of hydraulic control lines 42 and 44 to the main control valve 28.

The main control valve 28 controls the flow of pressurized hydraulic fluid from a pump 46 which is connected by a line 48 to an inlet 50 of the main control valve. Depending on the position of a valve spool 52, the main control valve 28 effects flow of the hydraulic fluid from pump 46 to either the first outlet or work port 26 or the second outlet or work port 32.

When the valve spool 52 is shifted to the left against the bias of the spring 53, then the spring projected valve head 54 opens to allow fluid in the inlet 50 to flow therepast into a power core defined by channels 56 and 58 connected to one another by chamber 60. The hydraulic fluid dispensed by the pump 46 then continues to flow through the power core over the cylinder 62 and out of the second outlet port 32 so as to apply pressurized hydraulic fluid to the chamber 22.

Hydraulic fluid is not applied to the outlet work port 26 when the valve spool is shifted left because cylinder 70 blocks flow through the channel 72 of the power core. This keeps the valve head 74 from retracting since hydraulic fluid is incompressible. Hydraulic fluid in the first chamber 20 of the hydraulic cylinder 12 will then exhaust through line 24 into work port 26 around cylinder 78 and down channel 80. A second spool cylinder 82 is shifted to the left so as to allow a connection between the channel 80 and an exhaust channel 84 which cooperates with the channel 80 to provide an exhaust core.

When the spool 52 is shifted all the way to the right against the bias of centering spring 86, the spool 70 clears the channel 72, allowing the valve head 74 to open under pressure in the inlet 50. The hydraulic fluid will then flow into chamber 87 and through channel 80, around cylinder 78 and out of the outlet port 26 so as to apply pressurized fluid to chamber 20 and move the working piston 14 to the right. In the meanwhile, the cylinder 90 blocks the channel 56 while the cylinder 92 clears exhaust channel 94, letting fluid flow from chamber 22 in the hydraulic cylinder 12 through channel 58 and out into the exhaust channel 94.

The direction in which the valve spool 52 shifts is determined by whether the joystick 36 is moved in the counterclockwise or the clockwise direction about pivot 100. When the handle 36 is in its neutral or upright position, the centering springs 86 and 53 keep the valve spool 52 in the position zone in FIG. 1 so that hydraulic fluid cannot flow in either direction.

Figure 2:
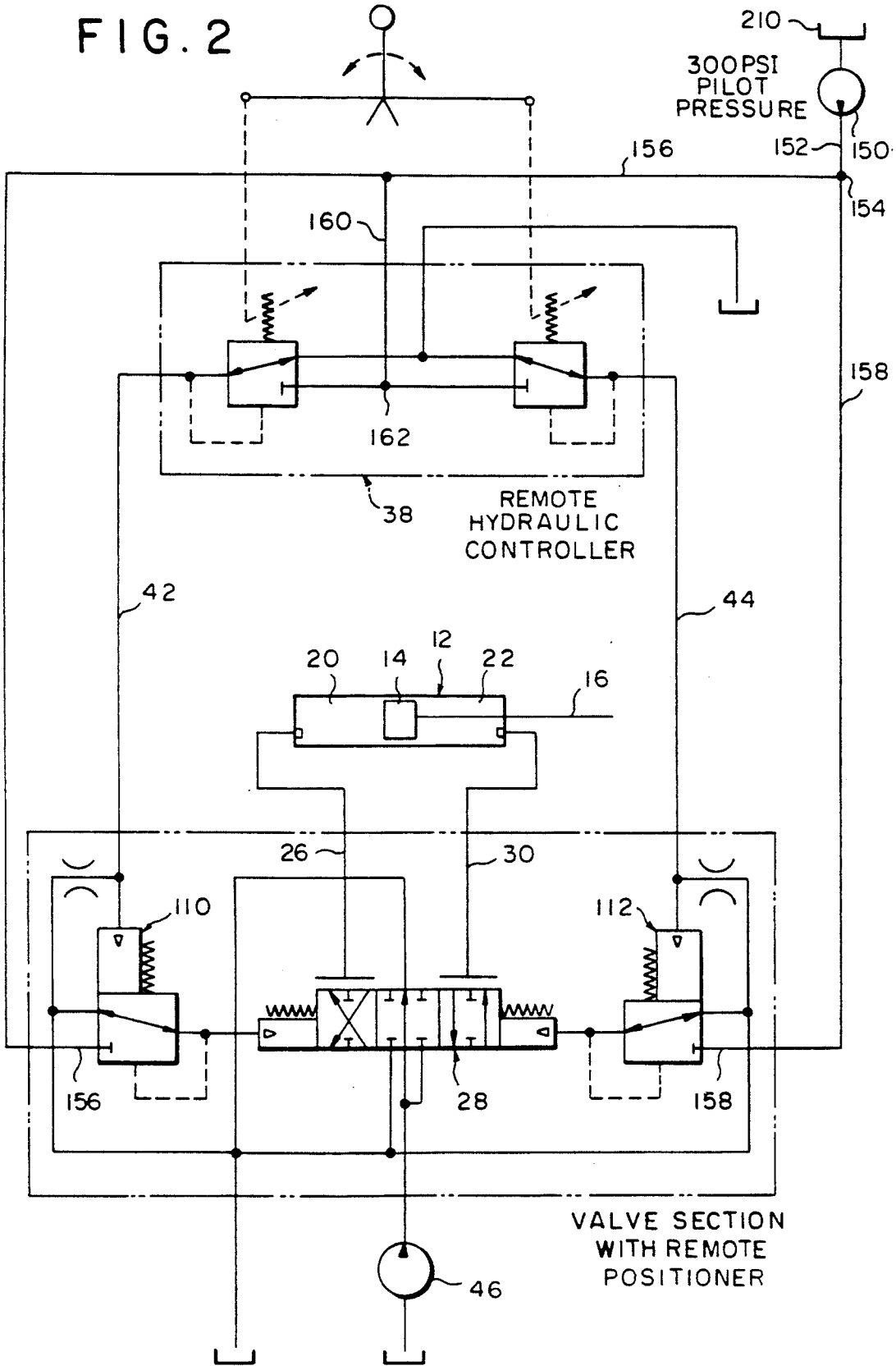
FIG. 2 is a schematic view, diagrammatically illustrating the operation of the hydraulic controller of FIG. 1.

The Remote Control Circuit (FIGS. 1 to 2)

In some applications, the hydraulic control lines 42 and 44 may be 50 ft. or more in length and are connected to hydraulic actuators 110 and 112 on opposed sides of the main control valve 28 so as to apply hydraulic pressure to first and second sides 114 and 116 of the valve spool 52. Hydraulic actuators 110 and 112 are connected to first and second chambers 118 and 120 so that pressurized hydraulic fluid in hydraulic control lines 42 and 44 can be applied to opposite ends of the valve spool 52 to shift the valve spool 52 from its neutral position shown in FIG. 1 to the first position in which fluid flows from first work port 26 to a second position in which fluid flows from the second work port 32.

Referring now more specifically to FIG. 2, there is shown a pump 150 which supplies hydraulic fluid at a first pilot pressure of, for example, 300–500 psi, over a line 152. The line 152 branches at point 154 and applies the first pilot pressure of 300–500 psi over line 156 to the first hydraulic actuator 110 and over line 158 to the second hydraulic actuator 112. Line 160 branching from line 156 delivers the hydraulic fluid at the first pilot pressure of 300–500 psi to the remote controller 38 through port 162 (see FIG. 1). As will be further explained hereinafter, the hydraulic fluid at the first pressure of 300–500 psi is selectively applied to chambers 118 and 120 in the main control valve 28. When hydraulic fluid at the first pressure is applied to chamber 110, the valve spool 52 moves to the right and, when the hydraulic pressure is applied to chamber 120, the valve spool 52 moves to the left. Operation of the joystick 36 in the remote control 38 selects which of the chambers 118 or 120 will receive hydraulic fluid at the first pilot pressure of 300–500 psi.

Referring now again more specifically to FIG. 1, when the joystick 36 is rotated in the counterclockwise direction, it pivots about pivot point 100 and depresses an actuator 180. In accordance with the instant invention, the actuator 180 applies a force which overcomes the bias of a spring 182 to move a piston valve 184 downwardly. When the piston valve 184 moves downwardly, a port 186 comes into alignment with a channel 188 to which the pilot pressure line 160 is connected. This allows hydraulic fluid to flow through the piston 184 into line 42. However, since, according to the present invention, the hole 186 is relatively small, the pilot hydraulic fluid is throttled and is applied to the line 42 at a second pilot pressure, substantially less than the first pilot pressure. The first pressure applied at line 160 is on the order of 300–500 psi, while the second pressure or control pressure is in the range of 25–475 psi and preferably 25–175 psi.

The line 42, which has a length of 50 ft. or greater, is connected through an inlet port 190 in the hydraulic actuator 110 and, in accordance with the principles of the instant invention, is applied to an actuator piston 192. When the piston 192 moves downwardly with respect to FIG. 1, hydraulic fluid at the elevated pilot pressure of 300 psi is applied to the chamber 118. In the illustrated embodiment, the pilot pressure on line 156 is applied to the main control valve through a port 194 (FIG. 1) and flows through an internal channel 195 from port 194 to a chamber 196. In accordance with the principles of the instant invention, when the piston 192 in the hydraulic actuator 110 is depressed, hydraulic fluid at the pilot pressure of 300–500 psi flows from the chamber 196 into a port 198 in a sliding valve member 200 and through a bore 202 in the valve member 200 to the chamber 118 to pressurize the chamber 118 at 300–500 psi.

In order for the valve spool 52 to move to the right, hydraulic fluid in the opposite chamber 120 must be evacuated. This occurs because fluid moves upwardly through a bore 204 in a valve member 206 into a chamber 208. The chamber 208 is connected by an internal channel 209 to the exhaust core 94 of the main control valve. From the exhaust core 94, the hydraulic fluid flows to a sump 210 upstream of the hydraulic pump 150. As was previously explained, when the valve spool 52 is in the right hand position, hydraulic fluid flows out of port 26 and enters chamber 20 to move the piston 14 in the hydraulic cylinder 12 to the right.

When the handle 36 is moved in the clockwise direction, plunger 220 overcomes the bias of spring 222 to move piston valve 224 downwardly. In accordance with the instant invention, this aligns the small port 226 with the channel 180 so that hydraulic fluid at the first pilot pressure of 300–500 psi is throttled through the opening 226 and flows through hydraulic control line 44 into the hydraulic actuator 112 at a reduced control pressure of 25 to 475 psi and preferably 25 to 175 psi. The pressure causes an actuator piston 230 to move downwardly which moves the sliding valve member 206 downwardly, aligning port 232 with the annular chamber 234. The annular chamber 234 is connected to a pilot inlet port 236 by an internal channel in the main control valve which allows the pilot fluid to pass through the central bore 204 and into the second chamber 120, thus pressurizing the second chamber and moving the valve spool 52 to the left. As the valve spool 52 moves to the left, the hydraulic fluid within chamber 118 is exhausted up through the bore 202 and the valve 200 and out of an exhaust port 240 into an exhaust chamber 242. The exhaust chamber 242 is connected by an internal passage 243 to the exhaust core 84 of the main control valve 28 and is evacuated to the sump 210 so that the valve spool 52 can move to the left against the bias of centering spring 53.

According to the instant invention, the pistons 192 and 230 have piston face areas equal to the piston faces on piston valves 184 and 224 and substantially less than the faces of valve spool 52. This results in response time being reduced by approximately ⅓ when pilot hydraulic fluid is applied at the reduced second pressure level to selectively move the actuator pistons 192 and 230 so as to cause hydraulic fluid at the first pressure level to shift the valve spool 52. The control system of the present invention requires a smaller displacement of hydraulic fluid to move the valve spool 52 than would be required in prior art approaches which do not use actuator pistons, such as the actuator pistons 192 and 230, of the present invention.

The Bleed-Off Structure

Figure 3:
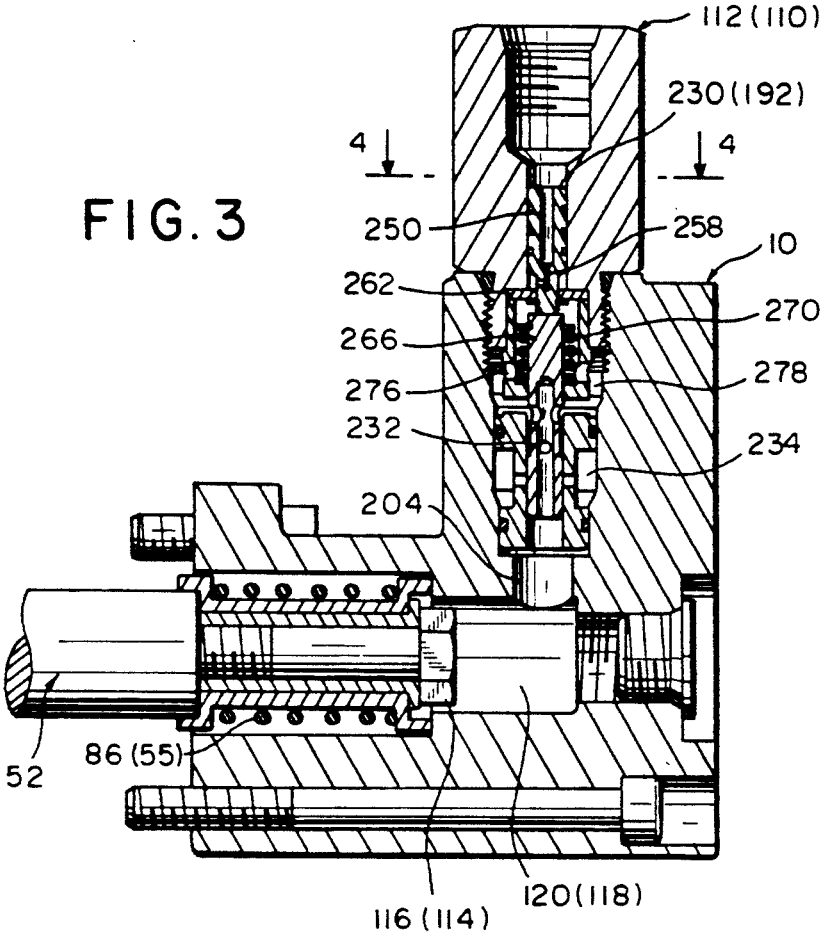
FIG. 3 is an enlarged elevation of one end of a control valve used with the hydraulic controller of FIGS. 1 and 2.
Figure 4:
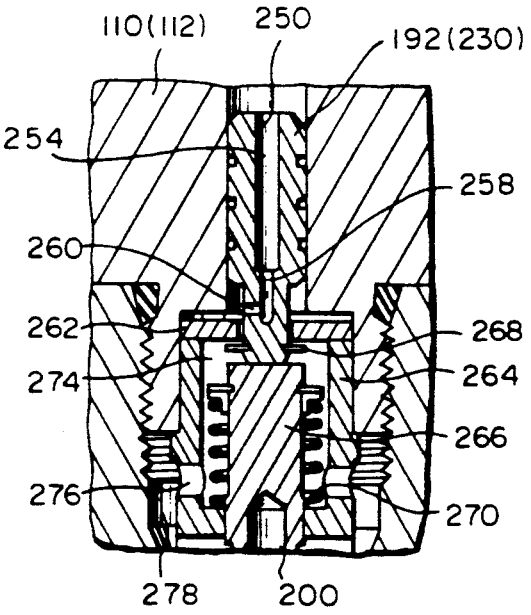
FIG. 4 is an enlarged view of a piston within an applicator portion of FIG. 3 when in an inoperative mode.
Figure 5:
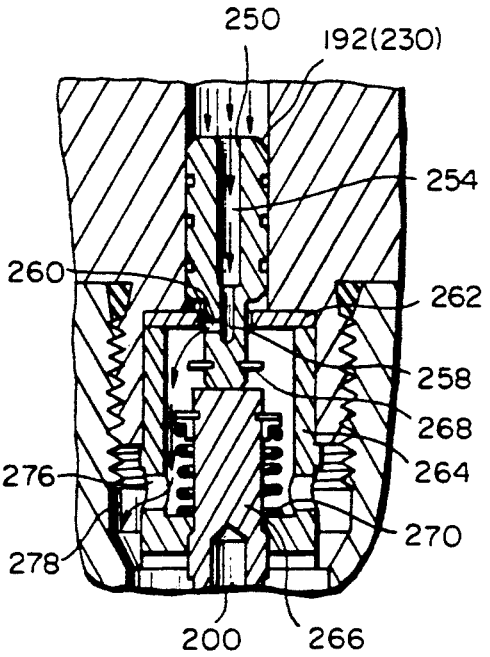
FIG. 5 is a view similar to FIG. 4 but showing the piston in an operative mode.

Referring now to FIGS. 3, 4 and 5, one of the hydraulic actuators 110 is shown in cross-section. In accordance with another feature of the instant invention, the piston 192 has a central bore 250. Since the hydraulic actuator 112 has the identical structure and operation of hydraulic actuator NO, only the component is hydraulic actuator 110 will be discussed. Central bore 250 has a large diameter portion 254 and a small diameter portion 258. The small diameter portion 258 is connected to a laterally extending bleed-off orifice 260. When the piston 192 is in the undepressed state of FIG. 4, the bore 260 is disposed above upper end plate 262 of a cylinder 264 which retains the upper end 266 of the valve 200. Annular washer 268 keeps the piston 192 positioned with respect to the plate 262, while coil spring 270 urges the valve 200 upwardly against the nose of the piston 192 and urges the washer 268 against the upper end plate 262 so that the piston remains in place.

The piston 192 moves downwardly upon applying hydraulic fluid pressurized to the second pilot pressure level of 25–475 psi over control line 42 in accordance with the principles of the instant invention. This not only moves the valve 266 downwardly, but also connects the lateral bore 260 with a chamber 274 in which the end 266 of the valve 200 is disposed. Hydraulic fluid then flows out through a port 276 in the casing 264 and into an annular channel 278. From the annular channel 278, the bled-off hydraulic fluid flows through the channel 243 within the main control valve 28 to the exhaust core 84 of the main control valve 28.

Considering FIG. 1 in combination with FIGS. 3, 4 and 5, upon returning the joystick 36 to its central position, the valve 184 within the control 38 returns to the position of FIG. 1, wherein a lateral port 282 aligns with an annular chamber 284 which is connected to a channel 286. The channel 286 has an outlet port 288 which is connected to a return line 290 which dumps into a sump 292.

Since the line 42 is 50 ft. long, it would ordinarily take a relatively long time for the hydraulic fluid in the control lines 42 and 44 to return through the control line so that the pistons 192 and 230 returns to their FIG. 1 position. In accordance with the instant invention, by providing the actuator pistons 192 and 230 in the hydraulic actuators 110 and 112 with axial 250 and radial bores 260 (FIGS. 4 and 5), pilot hydraulic fluid at the second operating pressure is continuously bled-off when the actuator pistons are in the operative mode. When the joystick 36 is returned to its upright center position shown in FIG. 1, the actuator pistons 192 and 230 are able to move from their operative to their inoperative position more quickly, substantially decreasing the "off" time. As is illustrated in the following examples, the "on" time is slightly increased by bleeding off pilot hydraulic fluid applied to the pistons 192 and 230, but this increase is not sufficiently high to adversely effect operation of the system. According, the overall response characteristics of the system are enhanced.

The pressure applied to the valve spool 52 is the same as the control pressure or pilot pressure from the remote source 150 (FIG. 2) because the same size pistons are used for the pressure reducing valves 84 and 224 as for the actuating pistons 92 and 230. The bleed-off arrangement provided by the orifices 250 and 260 in the piston 192 (and 230) allow pressure from the remote control operator 38 to decrease rapidly when the pressure on lines 42 and 44 is removed.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever.

The entire disclosures of all applications, patents and publications, cited above and below, are hereby incorporated by reference.

EXAMPLE

Telelect HR/FRV

"ON" time #1 = 1st work port (26, 32) pressure
"ON" time #2 = 1GPM flow from work port (26, 32)
"OFF" time = decrease to 1GPM flow from work port (26, 32)

Response Time

Using model Nos. V20-5909 and HC-436, available from the Gresen Division of the Dana Corporation, with 500 psi pilot pressure, oil temperature @100° F., controller pressure 25–425 psi, 50 ft. of 0.375 o.d.×0.9 wall hose (42, 44), response time is:

| Positioner | "ON" time #1 | "ON" time #2 | "OFF" time |
|---|---|---|---|
| Std. HR (Prior Art) | 550 msec | 930 msec | 600 msec |
| HR/PRV (Present Invention) | 150 msec | 270 msec | 630 msec |
| HR/PRV (Present Invention with 0.3 bleed orifice) | 180 msec | 360 msec | 230 msec |

The standard HR positioner and HC of the prior art with 50 ft. hoses (42, 44) requires that 0.137 cubic inches of oil displacement to stroke the valve spool when selecting from neutral to full power. The oil travels the distance of two hose lengths to the pressurized actuators 110 and 112 and two distances from the actuators upon exhaust.

*displacement* = 0.75dia.×.310 stoke

Replacing the standard HR positioner with the hydraulic/ proportional positioner (main control valve 28) according to the present invention reduces the amount of oil displacement required to 0.0035 cubic inches through the hoses (42, 44). Oil displacement in the actuator remains the same. Response time in the "on" condition is reduced to approximately ⅓. Response time in the "off" condition remains about the same.

*displacement* = 0.235dia.×0.080 stoke

Adding a 0.03 diameter bleed orifice (radial bore 260) to the hydraulic/ proportional positioner (main control valve 28) between control pressure and the internal exhaust of the bonnet reduced the "off" time by approximately ⅓. The "on" time increased 2 times but still remains acceptable in that the "on" time for the prior art positioner is still 3 times as long. Having faster "off" time would be more desirable in spite of slower "on" time.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. In a remote control system for operating a hydraulically driven device with a main control valve having therein a valve spool with end faces thereon; wherein the main control valve includes chambers on opposite ends of the valve spool each connected to a source of pilot hydraulic fluid pressurized to a first pressure level for moving the valve spool upon application of pilot hydraulic fluid at the first pressure level to control the hydraulically driven device, and wherein a remote controller selects which chamber will be pressurized by the hydraulic fluid, the improvement comprising:

a hydraulic actuator in communication with each of the chambers, each hydraulic actuator including; an actuator piston having a piston face of a selected area to which the pilot hydraulic fluid is applied at a second pressure level less than the first pressure level; a valve movable by the actuator piston from a first position wherein the valve blocks flow of pilot hydraulic fluid at the first pressure level to the chamber in communication with the actuator and a second position wherein the valve permits flow of the pilot hydraulic fluid at the first pressure level to the chamber, and means for bleeding the pilot hydraulic fluid applied at the second level past the actuator piston when the actuator piston is in the second position.

2. The improvement of claim 1, wherein the remote controller is connected to the hydraulic actuator in fluid communication with each of the chambers by a hydraulic line of a length of at least as long as a selected length.

3. The improvement of claim 2, wherein the selected length is about 50 feet.

4. The improvement of claim 1, wherein the piston face of the actuator piston has an area substantially less than the end faces of the valve spool.

5. The improvement of claim 4, wherein the hydraulic actuators are integral with the main control valve and wherein the means for bleeding the pilot hydraulic fluid applied at the second pressure comprises an orifice in each actuator piston which communicates with an exhaust core in the main control valve.

6. The improvement of claim 1, wherein the remote controller includes a piston valve operated by the remote controller, the piston valve including a piston face of an area substantially equal to the area of the actuator piston face.

7. The improvement of claim 1, wherein the means for bleeding the pilot hydraulic fluid applied at the second pressure comprises an orifice in each actuator piston.

8. A hydraulic control system for control of hydraulic operating fluid comprising:

a main control valve including a valve spool shiftable between a neutral position in which flow of the operating hydraulic fluid is blocked, a first operative position in which the hydraulic operating fluid flows from a first outlet in the main control valve and a second operative position in which the operating hydraulic fluid flows from a second outlet in the main control valve, the valve spool being shiftable by hydraulic pressure selectively applied to first and second opposed ends thereof;

first and second hydraulic pressure actuators connected to the main control valve proximate the first and second ends of the spool, respectively, for selectively applying hydraulic pressure thereto;

a controller having first and second hydraulic lines connected to the first and second hydraulic pressure actuators and means for selecting one of the hydraulic lines for pressurization;

a source of pilot hydraulic fluid pressurized to a first selected pressure level;

means for connecting the source of pilot hydraulic fluid to the hydraulic pressure actuators at the first selected pressure level;

means for connecting the source of pilot hydraulic fluid to the controller;

means within the controller for reducing the first selected pressure level to a second selected pressure level and for connecting the source of pilot hydraulic fluid to the first and second hydraulic lines at the selected second pressure level upon selecting one of the hydraulic lines for pressurization;

actuator pistons in each actuator, the actuator pistons including means for connecting the hydraulic line connected to the associated actuator through to the respective end of the valve spool upon pressurizing the piston with the pilot hydraulic fluid at the second selected pressure level to move the pistons from an inoperative to an operative position, wherein the valve spool shifts from the neutral position to the first or second position; and means associated with each of the actuator piston for bleeding pilot hydraulic fluid past the piston when the piston moves to the operative position, whereby "off" response time of the system is reduced when the first and second hydraulic control lines are of a length substantially equal to or greater than a selected length.

9. The system of claim 8, wherein the means for bleeding the pilot hydraulic fluid past the actuator pistons comprises a bore through the pistons connecting pressure surfaces of the pistons to an unpressurized return line.

10. The system of claim 9, wherein the actuator piston is substantially cylindrical in shape and wherein the bore is an axial bore with a radial port.

11. The system of claim 8, wherein the first selected pressure is in the range of about 200 psi to about 600 psi and wherein the second selected pressure is in the range of about 25 to 475 psi.

12. In a main control valve having a valve spool shiftable between at least two positions upon application of hydraulic pressure from a source of pilot hydraulic fluid at a first selected pressure wherein the pilot hydraulic fluid is applied at the first selected pressure upon moving an actuator piston from an inoperative to an operative position upon applying pilot hydraulic fluid at a second selected pressure, lower than the first selected pressure, through hydraulic control lines of a length greater than a selected length, the improvement comprising:

means for bleeding a portion of the hydraulic fluid applied to the actuator piston at the second selected pressure past the piston and into a return line while the piston is in the operative position, the actuator piston having a first end surface to which hydraulic pressure is applied, a side surface and a second end surface, wherein the means for bleeding a portion of the hydraulic pilot fluid comprises an axial bore through the first end surface of the actuator piston, the axial bore communicating with a radial port through the side of the actuator piston proximate the second end surface of the piston.

13. The improvement of claim 12, wherein the first selected pressure is in a range of about 200 psi to 600 psi and the second selected pressure is in a range of about 25 to about 475 psi.

14. The improvement of claim 13, wherein the hydraulic control line has a selected length of about 50 feet.

15. The improvement of claim 12, wherein the hydraulic control line has a selected length of about 50 feet.

16. The improvement of claim 12, wherein the valve spool has a pair of opposed faces to which pressurized hydraulic fluid is applied at the first selected pressure and wherein there are a pair of pistons, each having the means for bleeding pilot hydraulic fluid therepast into the return line.

* * * * *